US008550774B2

(12) United States Patent
Maltson

(10) Patent No.: US 8,550,774 B2
(45) Date of Patent: Oct. 8, 2013

(54) TURBINE ARRANGEMENT AND METHOD OF COOLING A SHROUD LOCATED AT THE TIP OF A TURBINE BLADE

(75) Inventor: John David Maltson, Lincoln (GB)

(73) Assignee: Siemens Aktiengesellschaft, München (DE)

( * ) Notice: Subject to any disclaimer, the term of this patent is extended or adjusted under 35 U.S.C. 154(b) by 956 days.

(21) Appl. No.: 12/664,742

(22) PCT Filed: Jun. 18, 2008

(86) PCT No.: PCT/EP2008/057709
§ 371 (c)(1),
(2), (4) Date: Dec. 15, 2009

(87) PCT Pub. No.: WO2009/000728
PCT Pub. Date: Dec. 31, 2008

(65) Prior Publication Data

US 2010/0189542 A1 Jul. 29, 2010

(30) Foreign Application Priority Data

Jun. 25, 2007 (EP) ..... 07012388

(51) Int. Cl.
*F01D 25/12* (2006.01)

(52) U.S. Cl.
USPC ..... 415/116; 415/173.6

(58) Field of Classification Search
USPC ..... 415/116, 117, 170.1, 173.1, 173.5, 415/173.6, 174.5, 177, 178, 180; 416/174
See application file for complete search history.

(56) References Cited

U.S. PATENT DOCUMENTS

| | | | | |
|---|---|---|---|---|
| 3,314,649 | A * | 4/1967 | Erwin et al. | 415/176 |
| 3,816,022 | A * | 6/1974 | Day | 416/92 |
| 3,970,319 | A * | 7/1976 | Carroll et al. | 277/414 |
| 4,311,431 | A * | 1/1982 | Barbeau | 415/173.6 |
| 4,662,821 | A * | 5/1987 | Kervistin et al. | 415/174.5 |
| 4,752,185 | A * | 6/1988 | Butler et al. | 415/175 |
| 7,238,001 | B2 * | 7/2007 | Rushton | 415/110 |
| 7,273,347 | B2 * | 9/2007 | Rathmann | 415/173.6 |
| 7,334,985 | B2 * | 2/2008 | Lutjen et al. | 415/173.1 |
| 2007/0071593 | A1 | 3/2007 | Rathmann | |

FOREIGN PATENT DOCUMENTS

| | | | |
|---|---|---|---|
| DE | 10336863 | A1 | 3/2004 |
| EP | 0365195 | A2 | 4/1990 |
| EP | 1083299 | A2 | 3/2001 |
| EP | 1219788 | A2 | 7/2002 |
| GB | 2409247 | A | 6/2005 |
| RU | 31814 | U1 | 8/2003 |
| RU | 22890029 | C2 | 12/2005 |
| SU | 1749494 | A1 | 7/1992 |

* cited by examiner

*Primary Examiner* — Nathaniel Wiehe
*Assistant Examiner* — Ryan Ellis

(57) ABSTRACT

A turbine arrangement with a rotor and a stator surrounding the rotor forming a flow path for hot and pressurized combustion gases between the rotor and the stator is provided. The rotor defines a radial direction and a circumferential direction and includes turbine blades extending in the radial direction through the flow path towards the stator. The turbine blades have shrouds located at their tips and the stator includes a wall section along which the shrouds move when the rotor is turning. A supersonic nozzle is located in the wall section and is connected to a cooling fluid provider. The supersonic nozzle provides a supersonic cooling fluid flow towards the shroud. The supersonic nozzle is angled with respect to the radial direction towards the circumferential direction in such an orientation that the supersonic cooling fluid flow has a flow component parallel to the moving direction of the shroud.

11 Claims, 2 Drawing Sheets

TURBINE ARRANGEMENT AND METHOD OF COOLING A SHROUD LOCATED AT THE TIP OF A TURBINE BLADE

CROSS REFERENCE TO RELATED APPLICATIONS

This application is the US National Stage of International Application No. PCT/EP2008/057709, filed Jun. 18, 2008 and claims the benefit thereof. The International Application claims the benefits of European Patent Office application No. 07012388.0 EP filed Jun. 25, 2007, both of the applications are incorporated by reference herein in their entirety.

FIELD OF INVENTION

The present invention relates to a turbine arrangement with a rotor and a stator surrounding the rotor so as to form a flow path for hot and pressurised combustion gases between the rotor and the stator, the rotor comprising turbine blades extending in a substantially radial direction through the flow path towards the stator and having a shroud located at their tips. In addition, the invention relates to a method of cooling a shroud located at the tip of a turbine blade of a rotor while the rotor is turning.

BACKGROUND OF INVENTION

Shrouds at the radial outer end of gas turbine blades are used for sealing the gap between the tip of the turbine blade and the turbine stator surrounding the turbine blade. By this measure a leakage flow through the gap between the tip and the stator is reduced. A typical shroud extends in the circumferential direction of the rotor and in the axial direction of the rotor along a substantial length of the turbine blade, in particular along its whole axial length, i.e. over a large area of the inner wall of the stator. In order to improve the sealing ability of the shroud there may be one or more sealing ribs, sometimes also called fins, which extend from a platform part of the shroud towards the inner wall of the stator.

As the shrouds, like the other parts of the turbine blades, are exposed to the hot pressurised combustion gas flowing through the flow path between the stator and the rotor one aims to sufficiently cool the shrouds to prolong their lifespan. A cooling arrangement in which air is blown out of bores in the stator towards the platform of the shroud for realising an impingement cooling of the shroud is described in US 2007/071593 A1.

EP 1 083 299 A2 describes a gas turbine with a stator and a rotor from which turbine blades extend towards the stator. At the radial outer tip of a turbine blade a shroud is located which faces a honeycomb seal structure at the inner wall of the stator. Cooling air is blown out of an opening in the stator wall into the gap between the shroud and the stator wall directly upstream from the honeycomb seal structure.

SUMMARY OF INVENTION

Compared to the state of the art it is an objective of the present invention to provide an improved turbine arrangement which includes a stator and a rotor with turbine blades extending substantially radially from the rotor towards the stator and having shrouds at their tips. In addition, it is a second objective of the present invention to provide a method of cooling a shroud located at the tip of a turbine blade of a rotor while the rotor is turning.

The first objective is solved by a turbine arrangement according to the claims. The second objective is solved by a method of cooling a shroud as claimed in the claims. The depending claims contain further developments of the invention.

An inventive turbine arrangement comprises a rotor and a stator surrounding the rotor so as to form a flow path for hot and pressurised combustion gases between the rotor and the stator. The rotor defines a radial direction and a circumferential direction and comprises turbine blades extending in the radial direction through the flow path towards the stator and having a shroud located at their tip. The stator comprises a wall section along which the shroud moves when the rotor is turning. At least one supersonic nozzle is located in the wall section and connected to a cooling fluid provider. The supersonic nozzle is located such as to provide a supersonic cooling fluid flow towards the shroud. In addition, it is angled with respect to the radial direction towards the circumferential direction in such an orientation that the supersonic cooling fluid flow has a flow component parallel to the moving direction of the shroud. A supersonic nozzle may be simply realised by a converging-diverging nozzle cross section.

With this arrangement the flow towards the shroud will have a very high velocity. This flow will mix with an overlap leakage through the radial gap between the shroud and the inner wall of the stator. This leakage has a lower velocity in the circumferential direction than the supersonic flow emerging from the supersonic nozzle. Thus, by mixing the leakage flow with the supersonic flow the supersonic flow will increase the circumferential velocity of the mix which will lead to a lower relative velocity in the shroud's rotating frame of reference, whereby the cooling efficiency of the shroud cooling is increased. In contrast thereto, the relative circumferential velocity of the shroud and the gas in the gap between the shroud and the stator is high in the state of the art cooling arrangements. Hence, in such arrangements the friction between the gas and the shroud is high and, as a consequence, the temperature of the gas is increased. This increase lowers the capability of heat dissipation from the shroud.

The cooling fluid provider may be the gas turbine's compressor which also supplies the combustion system with combustion air. The cooling fluid is then just compressed air from the compressor. An additional cooling fluid provider is thus not necessary.

A seal is advantageously located in the wall section along which the shroud moves. This seal is partly or fully plain and the supersonic nozzle is located in the plain seal or its plain section if it is only partly plain. Such a plain seal (section) reduces friction between the supersonic flow and the stator wall as compared to non-plain seals.

The seal in the stator's wall may, in particular, comprise a plain section and a honeycomb section where the honeycomb section is located upstream from the plain section. By this configuration the effectiveness of sealing upstream from the supersonic nozzle can be increased without substantially increasing the friction between the supersonic flow and the stator wall.

In addition to the supersonic cooling fluid flow an impingement jet may be directed onto the shroud. To achieve this, an impingement jet opening would be present upstream from the seal in the stator. This opening would be located and oriented such as to provide an impingement jet directed towards the shroud. However, although not explicitly mentioned hitherto, the supersonic flow emerging from the supersonic nozzle can also impinge on the shroud so as to provide some degree of impingement cooling. Furthermore, if the pressure difference between the leakage and the cooling fluid from the cooling fluid provider is high enough, which may be the case for a second or higher turbine stage or for a first turbine stage with a transonic nozzle guide vane, the impingement jet opening could also be implemented such as to provide a supersonic cooling fluid flow with or without an inclination towards the circumferential direction of the rotor.

In the inventive method of cooling a shroud located at the tip of a turbine blade of a rotor while the rotor is turning a supersonic cooling fluid flow is provided which has a component in its flow direction that is parallel to the moving direction of the shroud of the turning rotor blade. Such supersonic cooling fluid flow would mix with a leakage flow flowing in the substantially axial direction of the rotor through the gap between the shroud and the inner wall of the stator. The mixture of the supersonic cooling fluid flow and the leakage flow would, as a consequence, have a circumferential velocity component that decreases the relative velocity between the shroud and the gas flow through the gap. The velocity reduction in the turbine frame of reference leads to a reduced warming of the gas in the gap by the movement of the rotating rotor and hence to an improved cooling efficiency as warming the gas by the movement would mean a reduced capability of dissipating heat from the shroud itself.

In addition, the supersonic cooling fluid flow may have a radial component which allows it to impinge on the shroud so as to provide some degree of impingement cooling.

BRIEF DESCRIPTION OF THE DRAWINGS

Further features, properties and advantages of the present invention will become clear from the following description of embodiments in conjunction with the accompanying drawings.

DETAILED DESCRIPTION OF INVENTION

Figure 1:
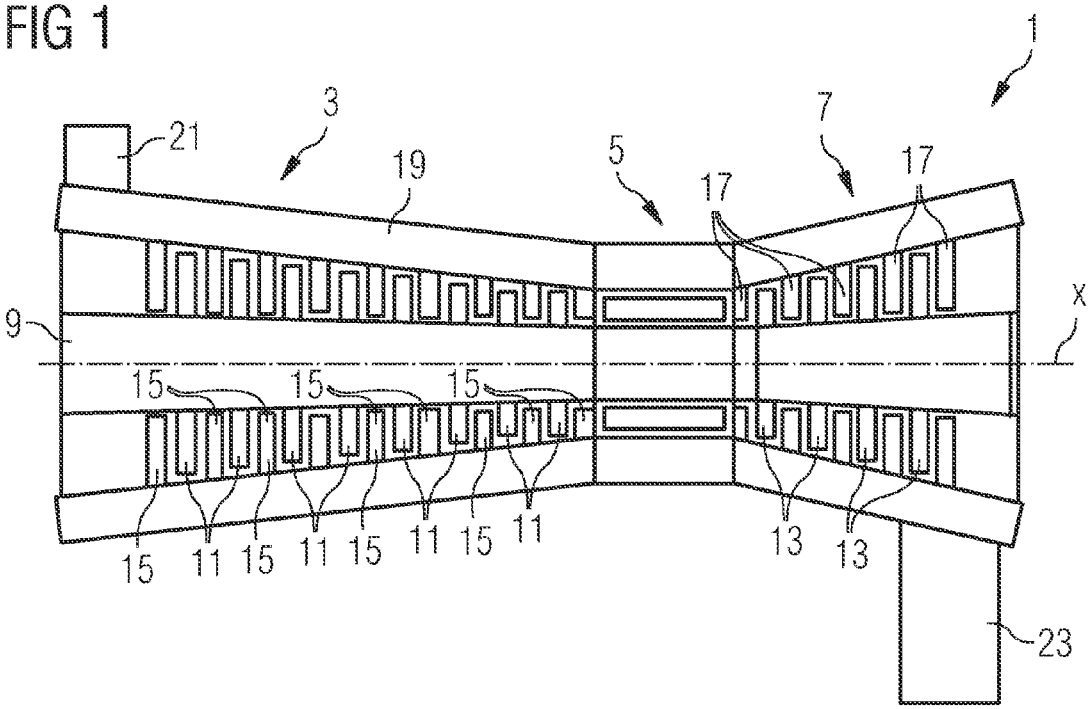
FIG. 1 shows a gas turbine engine in a highly schematic view.

FIG. 1 shows, in a highly schematic view, a gas turbine engine 1 comprising a compressor section 3, a combustor section 5 and a turbine section 7. A rotor 9 extends through all sections and comprises, in the compressor section 3, rows of compressor blades 11 and, in the turbine section 7, rows of turbine blades 13 which may be equipped with shrouds at their tips. Between neighbouring rows of compressor blades 11 and between neighbouring rows of turbine blades 13 rows of compressor vanes 15 and turbine vanes 17, respectively, extend from a stator or housing 19 of the gas turbine engine 1 radially inwards towards the rotor 9.

In operation of the gas turbine engine 1 air is taken in through an air inlet 21 of the compressor section 3. The air is compressed and led towards the combustor section 5 by the rotating compressor blades 11. In the combustor section 5 the air is mixed with a gaseous or liquid fuel and the mixture is burnt. The hot and pressurised combustion gas resulting from burning the fuel/air mixture is fed to the turbine section 7. On its way through the turbine section 7 the hot pressurised gas transfers momentum to the turbine blades 13 while expanding and cooling, thereby imparting a rotational movement to the rotor 9 that drives the compressor and a consumer, e.g. a generator for producing electrical power or an industrial machine. The expanded and cooled combustion gas leaves the turbine section 7 through an exhaust 23.

Figure 2:
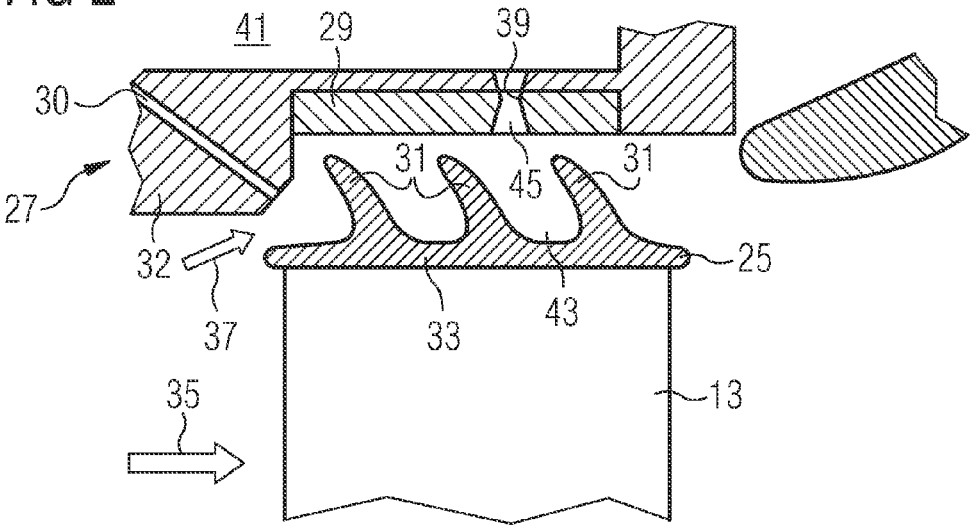
FIG. 2 shows a first embodiment of the inventive turbine arrangement in a section along the axial direction of the rotor.
Figure 3:
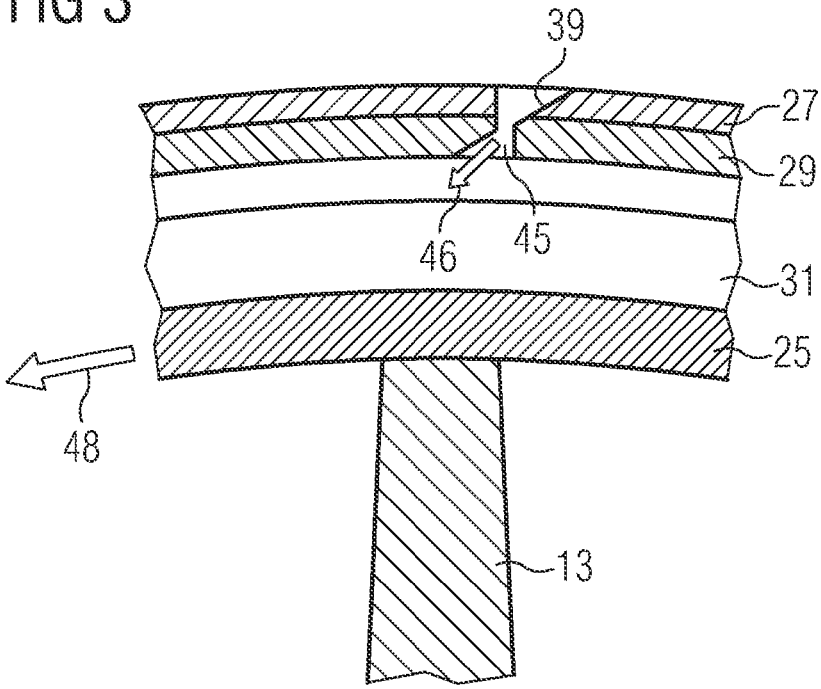
FIG. 3 shows the turbine arrangement of FIG. 1 is a section along the radial direction of the rotor.

A first embodiment of the inventive turbine arrangement will be described with respect to FIGS. 2 and 3. While FIG. 2 shows a section through the arrangement along the rotor's axial direction, FIG. 3 shows a section of the arrangement along the rotor's radial direction. The figures show a turbine blade 13 with a shroud 25 located at its tip, i.e. its radial outer end. It further shows a wall section 27 of the stator 19 (or housing) of the turbine. A plain seal 29 is located on the inner surface of the inner wall 27 where the shroud 25 faces the wall. The shroud 25 is equipped with fins 31 extending radially outwards from a shroud platform 33 towards the seal 29. These fins 31 provide a labyrinth seal function that reduces the pressure of a gas flowing through the gap between the shroud 25 and the wall 27. A cooling channel 30 is provided in an upstream section 32 of the wall 27 by which an impingement jet can be blown towards an upstream part of the shroud 25.

The main flow direction of the hot and pressurised combustion gases is indicated by the arrow 35 in FIG. 2. A minor part of the flow leaks through the gap between the shroud 25 and the wall 27 of the stator 19. This leakage flow is indicated by arrow 37. This leakage flow 37 is mainly directed parallel to the axial direction of the rotor 9. The pressure of the leakage flow will be reduced by the labyrinth seal.

A converging-diverging nozzle 39 is provided in the stator wall 27. This nozzle forms the supersonic nozzle which connects the gap between the shroud 25 and the wall 27 with a plenum 41 at the other side of the wall 27. The plenum 41 is in flow connection with the compressor exit and hence contains compressed air from the compressor. The compressed air from the compressor is let through the plenum 41 to the supersonic nozzle 39 and blown out by the nozzle towards the shroud 25. Increased velocities of the cooling fluid are achieved by the use of the converging-diverging configuration of the nozzle where supersonic flows are generated at the nozzle's exit opening 45.

The nozzle 39 is arranged such in the wall section 27 and the plain seal 29 that its exit opening 45 faces a downstream cavity 43 which is defined by the space between the two most downstream fins 31. Therefore, the supersonic cooling fluid flow emerges from the nozzle 39 into this downstream cavity 43 where the gas pressure has already been reduced by the action of the fin 31 being located upstream of the cavity. Therefore a high pressure ratio is obtained by using high pressure compressor delivery air for the cooling fluid supply to the nozzle 39.

The nozzle 39 is inclined with respect to the radial direction of the rotor 9, as can be seen in FIG. 3. The inclination is such that the supersonic cooling fluid flow enters the gap between the shroud 25 and the wall 27 with a velocity component which is parallel to the moving direction 48 of the shrouds 25 when the rotor is rotating. The flow direction at the nozzle's exit opening 45 is indicated by arrow 46. Hence, the supersonic cooling air flow is pre-swirled in the same direction as the rotor blade 13 with the shroud 25 rotates.

At the exit opening 45 of the converging-diverging nozzle the flow will be supersonic and have a very high velocity. This supersonic cooling air flow will mix with the leakage flow entering the gap between the shroud 25 and the wall 27 along the flow path which is indicated by arrow 37. This leakage flow will have a lower velocity in the circumferential direction and thus be a source of friction between the leakage flow 37 and the shroud 25. By introducing the supersonic cooling fluid flow 46 with a circumferential velocity direction the velocity of the mix of supersonic cooling air and leakage flow will be increased in the circumferential direction of the rotor 9. The higher flow velocity in the circumferential direction will give lower relative temperature in the rotating reference frame as the friction is reduced and will thus aid cooling of the shroud 25. Also the plain structure of the seal 29 reduces friction, namely between the seal 29 and the mix of supersonic cooling air and leakage flow.

Figure 4:
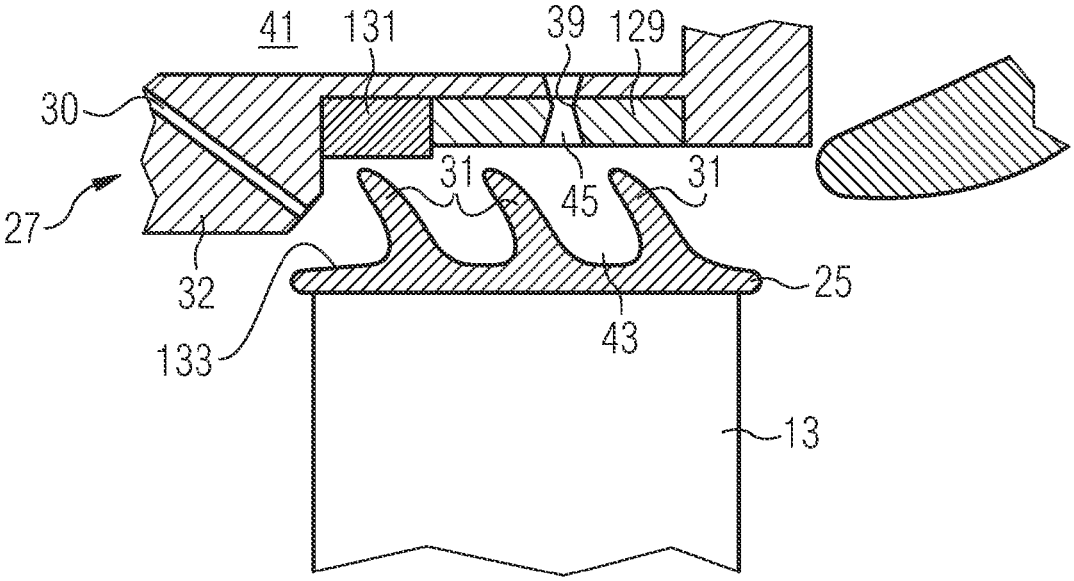
FIG. 4 shows a second embodiment of the inventive turbine arrangement in a section along the axial direction of the rotor.

A second embodiment of the inventive turbine arrangement is shown in FIG. 4. FIG. 4 shows a section through the shroud 25 and the wall 27 of the stator which is taken along the axial direction of the rotor 9. Elements which are identical to elements of the first embodiment are designated with the same reference numerals as in FIG. 2 and will not be described again in order to avoid repetition.

The difference between the first embodiment shown in FIGS. 2 and 3 and the second embodiment shown in FIG. 4 lies in the seal. While the seal in the first embodiment is a simple plain seal 29, the seal in the second embodiment is a combination of a plain seal section 129 and a honeycomb seal section 131. While the plain seal section 129 is located in a downstream section of the wall facing the shroud 25, the honeycomb seal section 131 is located in an upstream section of the wall facing the shroud 25. By this measure the sealing efficiency of the labyrinth seal can be increased. The extension of this honeycomb seal section 131 covers only the area from the shroud's upstream edge 133 to the rear end, as seen in the axial direction of the rotor 9, of the fin 31 located most upstream of all fins.

This second embodiment is particularly suitable for use in conjunction with turbines of large size. However, a plain seal section should surround the converging-diverging nozzle 39 to give reduced friction as compared to a honeycomb seal and therefore not to reduce the velocity of the fluid in the gap in the circumferential direction of the rotor 9. Otherwise, the second embodiment does not differ from the first embodiment.

Although only one supersonic nozzle 39 has been described, supersonic nozzles will usually be distributed over the whole circumference of those stator wall sections facing shrouds of turbine blades.

The invention claimed is:

1. A turbine arrangement, comprising:

a rotor, comprising:

a plurality of turbine blades extending in a radial direction through a flow path towards a stator and each blade includes a shroud located at a tip of the blade; and the stator surrounding the rotor forming the flow path for hot and pressurised combustion gases between the rotor and the stator, the stator comprising:

a wall section, wherein the rotor defines the radial direction and a circumferential direction, wherein a plurality of shrouds move along the wall section when the rotor is turning, wherein a supersonic nozzle is located in the wall section and is connected to a cooling fluid provider and located such as to provide a supersonic cooling fluid flow towards the shroud, and wherein the supersonic nozzle is angled with respect to the radial direction towards the circumferential direction in such an orientation that the supersonic cooling fluid flow includes a flow component parallel to a moving direction of the shroud.

2. The turbine arrangement as claimed in claim 1, wherein the cooling fluid is compressed air, and wherein the cooling fluid provider is a compressor of the turbine.

3. The turbine arrangement as claimed in claim 1, wherein a seal is located in the wall section, wherein the seal is a plain seal or at least a partly plain seal, wherein the shroud moves along the wall section, and wherein the supersonic nozzle is located in the plain seal or in a part of the seal that is plain.

4. The turbine arrangement as claimed in claim 3, wherein the supersonic nozzle is arranged in the seal and the wall section so that an exit opening of the supersonic nozzle faces a downstream cavity defined by a space between two most downstream fins of the shroud of a plurality of downstream fins.

5. The turbine arrangement as claimed in claim 3, wherein the seal comprises a plain section and a honeycomb section, and wherein the honeycomb section is located upstream to the plain section.

6. The turbine arrangement as claimed in claim 3, wherein an impingement jet opening is present upstream to the seal in the wall section which is located and oriented such as to provide an impingement jet directed towards the shroud.

7. The turbine arrangement as claimed in claim 6, wherein the supersonic nozzle opening includes a converging-diverging nozzle cross section.

8. A method of cooling a shroud located at a tip of a turbine blade of a rotor while the rotor is turning wherein the rotor defines a radial direction and a circumferential direction and the turbine blade extending in the radial direction, comprising:

providing a supersonic nozzle located in a wall section of a stator which surrounds the rotor wherein the supersonic nozzle is connected to a cooling fluid provider;

providing a supersonic cooling fluid flow by the supersonic nozzle towards the shroud, the supersonic cooling flow angled with respect to the radial direction towards the circumferential direction including a flow component in a flow direction of the supersonic cooling fluid flow which is parallel to a moving direction of the shroud of the turning turbine blade.

9. The method as claimed in claim 8, wherein the supersonic cooling fluid flow is mixed with cooling fluid flow and/or combustion gas flow coming from an upstream direction.

10. The method as claimed in claim 8, wherein the supersonic cooling fluid flow has a radial component which allows the supersonic cooling fluid flow to impinge on the shroud.

11. The method as claimed in claim 8, wherein a cooling fluid is compressed air, and wherein a cooling fluid provider is a compressor of a turbine associated with the rotor.

* * * * *